US009121399B2

(12) United States Patent
Bovill

(10) Patent No.: US 9,121,399 B2
(45) Date of Patent: Sep. 1, 2015

(54) STRAINER FOR A BILGE PUMP

(75) Inventor: Richard Bovill, Comber (GB)

(73) Assignee: Munster Simms Engineering Limited, Bangor (IE)

( * ) Notice: Subject to any disclaimer, the term of this patent is extended or adjusted under 35 U.S.C. 154(b) by 937 days.

(21) Appl. No.: 13/262,302

(22) PCT Filed: Mar. 31, 2010

(86) PCT No.: PCT/EP2010/002067

§ 371 (c)(1),
(2), (4) Date: Sep. 30, 2011

(87) PCT Pub. No.: WO2010/112214

PCT Pub. Date: Oct. 7, 2010

(65) Prior Publication Data

US 2012/0024767 A1 Feb. 2, 2012

(30) Foreign Application Priority Data

Mar. 31, 2009 (GB) ..... 0905520.3

(51) Int. Cl.

| | |
|---|---|
| ***B01D 35/28*** | (2006.01) |
| ***F04B 49/00*** | (2006.01) |
| ***F04B 49/02*** | (2006.01) |
| ***F04B 53/20*** | (2006.01) |
| ***F04D 15/02*** | (2006.01) |
| ***F04D 29/70*** | (2006.01) |

(52) U.S. Cl.

CPC ..... *F04B 49/02* (2013.01); *F04B 53/20* (2013.01); *F04D 15/0218* (2013.01); *F04D 29/708* (2013.01)

(58) Field of Classification Search

None

See application file for complete search history.

(56) References Cited

U.S. PATENT DOCUMENTS

| | | | | |
|---|---|---|---|---|
| 4,744,808 | A | 5/1988 | Treu | |
| 7,373,817 | B2 * | 5/2008 | Burdi et al. | 73/290 R |
| 7,625,187 | B2 * | 12/2009 | Collins et al. | 417/36 |
| 8,380,355 | B2 * | 2/2013 | Mayleben et al. | 700/282 |
| 2007/0048157 | A1 * | 3/2007 | Collins et al. | 417/423.3 |

(Continued)

FOREIGN PATENT DOCUMENTS

| | | |
|---|---|---|
| DE | 10246017 | 4/2004 |
| EP | 0620331 | 10/1994 |

(Continued)

OTHER PUBLICATIONS

Search Report, dated Jul. 20, 2010, corresponding to International Application No. PCT/EP2010/002067 (filed Mar. 31, 2010), parent of the present application, 4 pp.

(Continued)

*Primary Examiner* — Terry Cecil
(74) *Attorney, Agent, or Firm* — Lathrop & Gage LLP

(57) ABSTRACT

A straining device for a drainage pump, the straining device comprising a body defining an inner chamber; at least one straining element by which liquid may enter the chamber; and at least one outlet by which liquid may leave the chamber. The straining device further includes a liquid level sensor arranged to detect the level of a liquid in which said straining device is located during use and, upon determining that said liquid level exceeds a threshold, to cause an activation signal to be sent to said pump. The liquid level sensor comprises non-contact sensing means such as an electric field sensor. The sensor is located at the top of the straining device and arranged to project its sensing field upwardly.

24 Claims, 2 Drawing Sheets

(56) References Cited

U.S. PATENT DOCUMENTS

| | | | |
|---|---|---|---|
| 2008/0209628 | A1 | 9/2008 | Stimpson |
| 2008/0219856 | A1 | 9/2008 | Stimpson |
| 2008/0232976 | A1 | 9/2008 | Whittaker |

FOREIGN PATENT DOCUMENTS

| | | |
|---|---|---|
| EP | 1975416 | 10/2008 |
| GB | 2196736 | 5/1988 |
| GB | 2421055 | 6/2006 |
| GB | 2424368 | 9/2006 |
| GB | 2445612 | 7/2008 |
| GB | 2446370 | 8/2008 |
| JP | 2001041190 | 2/2001 |
| JP | 2003039064 | 2/2003 |
| WO | 2010/069551 | 6/2010 |
| WO | 2010/112214 | 10/2010 |

OTHER PUBLICATIONS

Written Opinion, dated Jul. 20, 2010, corresponding to International Application No. PCT/EP2010/002067 (filed Mar. 31, 2010), parent of the present application, 5 pp.

* cited by examiner

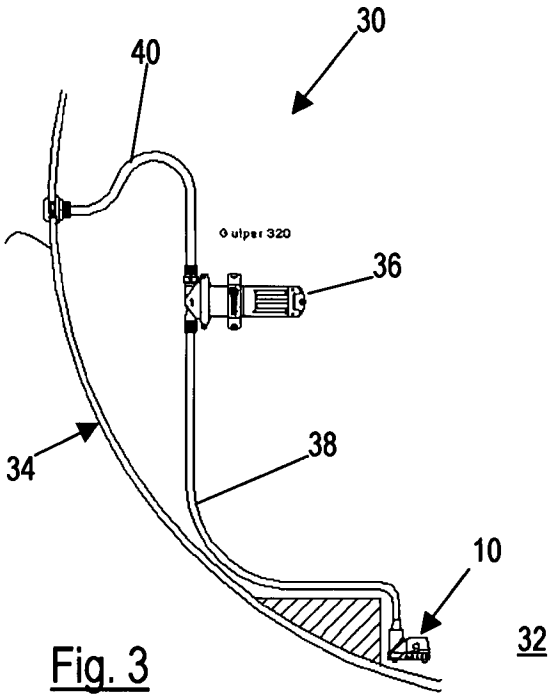
Fig. 3
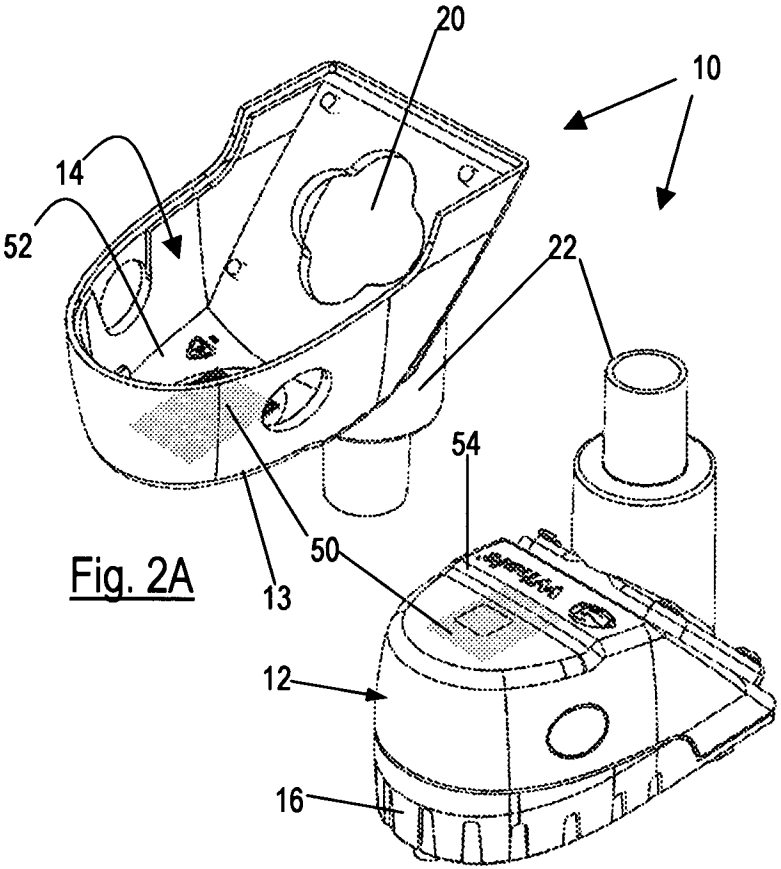
Fig. 2A
Fig. 1A

STRAINER FOR A BILGE PUMP

CROSS-REFERENCE TO RELATED APPLICATIONS

This application is a U.S. National Stage Application under 35 U.S.C. §371 of International Application No. PCT/EP2010/002067, filed Mar. 31, 2010, which claims the benefit of Great Britain Application No. 0905520.3, filed Mar. 31, 2009. Both of these applications are hereby incorporated by reference in their entireties.

FIELD OF THE INVENTION

The present invention relates to strainers for use with pumps, especially bilge pumps.

BACKGROUND TO THE INVENTION

Strainers for bilge pumps, commonly known as strum boxes, are well known. Their purpose is to prevent debris being drawn from the bilge of a vessel into the bilge pump. Traditionally, bilge pumps have been manually operated although, more recently, water level detectors, typically in the form of float switches, have been provided in the bilge area of a vessel separately from the strum to control the operation of powered bilge pumps. However, the provision of a water level detector increases the complexity of installation since it has to be correctly positioned in the bilge area with respect to the strainer. The water level detector also adds to the cost of the bilge pump system.

It would be desirable to provide a system that overcomes the problems outlined above.

SUMMARY OF THE INVENTION

Accordingly, a first aspect of the invention provides a straining device for a pump, especially a bilge pump, the straining device comprising a body defining an inner chamber; at least one straining element by which liquid may enter the chamber; and at least one outlet by which liquid may leave the chamber, wherein the straining device further includes a liquid level sensor arranged to detect the level of a liquid in which said straining device is located during use and, upon determining that said liquid level exceeds a threshold, to cause an activation signal to be sent to said pump.

Said liquid level sensor preferably comprises non-contact sensing means. Preferably, said liquid level sensor comprises at least one electric field sensor. In preferred embodiments, the sensor may comprise any conventional electromagnetic field sensor(s).

In preferred embodiments, said liquid level sensor is located substantially at the roof of said body, i.e. substantially at the top of the straining device. For example, said liquid level sensor may be located inside said chamber on an inner surface of said roof. Alternatively, said liquid level sensor may be located on an external surface of said roof, in which case it is preferably located within a substantially liquid-tight cover. Alternatively still, said liquid level sensor may be incorporated into the body.

The preferred arrangement is such that the sensing field generated by said liquid level sensor extends upwardly in use. Any components of the sensing field that may otherwise have extended downwardly are preferably suppressed or substantially eliminated. Laterally extending components of the sensing field may be present, although preferably only above the threshold level. In general, the preferred arrangement is such that the sensing field (or at least the sensing field that is responsible for activating the pump) exists only above said threshold. In preferred embodiments where the sensor is located at the roof, the arrangement is such that the sensing field extends from the roof in a direction substantially away from the body.

Preferably, said liquid level sensor is arranged to cause said activation signal to be generated when the detected liquid level indicates that said at least one outlet is substantially covered by said liquid. In preferred embodiments, said at least one outlet is arranged such that its top edge is substantially at or below the level of the roof. To this end, said at least one outlet is conveniently located in a side wall of said body.

Optionally, said liquid level sensor is arranged to cause a deactivation signal to be sent to the pump upon detecting that the liquid level has dropped below the threshold level. Alternatively, the sensor may be arranged to continuously or intermittently cause the activation signal to be sent until it determines that the liquid level has dropped below the threshold level, at which time the activation signal is terminated, termination of the activation signal being an indication that the pump is to be deactivated.

Optionally, the sensor may be arranged to delay causing the activation signal to be sent for a period of time until it has verified that the liquid threshold level has been exceeded, e.g. by establishing that a plurality of successive measurements indicate that the threshold is exceeded. Similarly, the sensor may be arranged to delay sending the deactivation signal, or to delay terminating the activation signal, as appropriate, for a period of time until it has verified that the liquid threshold level is not exceeded, e.g. by establishing that a plurality of successive measurements indicate that the threshold is not exceeded.

A second aspect of the invention provides a pump system, especially a bilge pump system comprising a straining device of the first aspect of the invention connected to a pump.

It is preferred that the pump is activated after a delay has elapsed from the time at which the sensor first detects that the liquid level threshold is exceeded when the pump is deactivated. This is conveniently implemented by a pump control system by, for example, configuring the control system to delay activation of the pump for a period of time after having received an activation signal from the sensor and, at the end of the delay period, to activate the pump only if a deactivation signal has not been received in the meantime, or if the activation signal has not terminated in the meantime (depending on the activation/deactivation protocol).

Similarly, it is preferred that the pump is deactivated after a delay has elapsed from the time at which the sensor first detects that the liquid level has dropped below the threshold when the pump is activated. This is conveniently implemented by a pump control system by, for example, configuring the control system to delay deactivation of the pump for a period of time after having received a deactivation signal from the sensor, or detected a termination of the activation signal, and, at the end of the delay period, to deactivate the pump only if an activation signal has not been received in the meantime.

Further advantageous aspects of the invention will become apparent to those ordinarily skilled in the art upon review of the following description of specific embodiments and with reference to the accompanying drawings.

BRIEF DESCRIPTION OF THE DRAWINGS

Embodiments of the invention are now described by way of example in which like numerals are used to indicate like parts and in which:

FIGS. 1A-1C are perspective views of a straining device embodying the invention;

FIGS. 2A and 2B are perspective views of an upper body portion the straining device of FIG. 1; and FIG. 3 is a schematic view of the straining device of FIG. 1 in situ.

DETAILED DESCRIPTION OF THE DRAWINGS

Figure 1B:
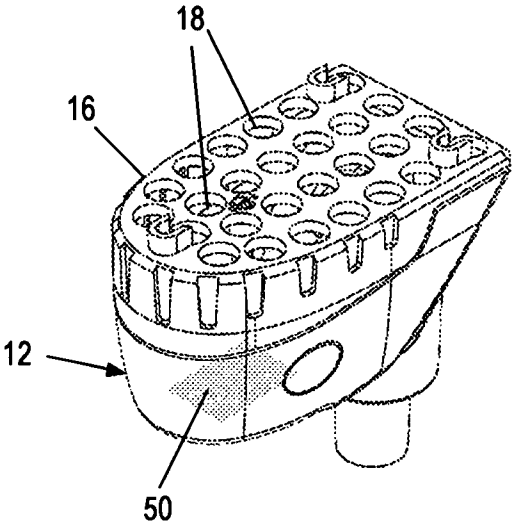
Figure 1C:
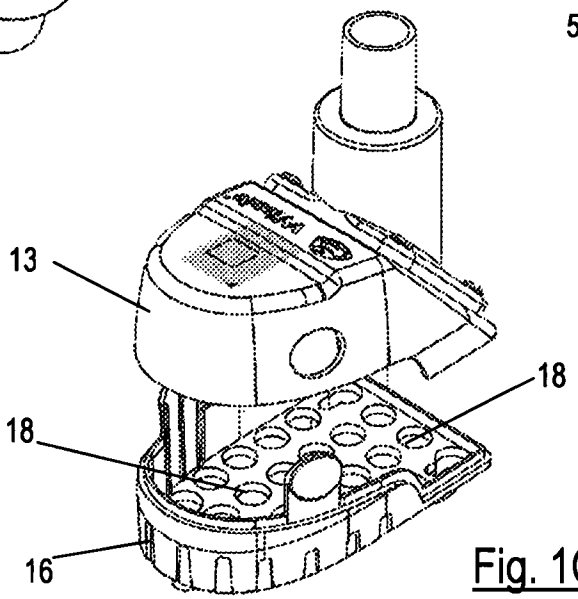
Figure 2B:
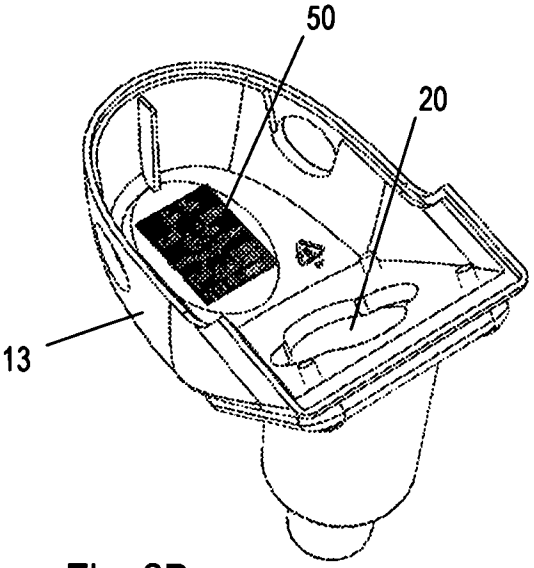

Referring now to FIGS. 1(*a*) to 1(*c*) and 2(*a*) to 2(*b*) of the drawings, there is shown, generally indicated as 10, a straining device, or strum box, embodying the invention. The strum box 10 includes a hollow body, or housing, 12 shaped to define an inner chamber 14. The body 12 includes a straining element 16 through which liquid, typically bilge water, can be drawn into the chamber 14. In the illustrated embodiment, the straining element 16 comprises a plurality of apertures 18 formed in a wall, preferably the bottom wall, of the body 12. The straining element 16 is preferably removable, for example by means of a mechanical interference mechanism. This can best be seen from FIG. 1 C, which shows the strainer 16 and upper body portion 13 in exploded view. The body 12 defines an outlet 20 from the chamber 14 leading to a connector 22 for receiving a drainage pipe (not shown in FIGS. 1(*a*) to 1(*c*) and 2(*a*) to 2(*b*).

FIG. 3 shows a bilge pump system 30 incorporating the strum box 10. The strum box 10 is located in the bilge area 32 of a vessel 34 (of which only part of the hull is shown for illustration purposes). The system 30 also includes a pump 36, in particular a bilge pump, which may take any suitable conventional form. The pump 36 is a power-operated, e.g. electrically operated, pump as opposed to being manually operated. A drainage pipe 38 is connected between the strum box 10 and the pump 36. A second drainage pipe 40 leads from the pump 36 to a drainage destination, in this case the exterior of the vessel 34. It will be seen that the pump 36 is remotely located with respect to the strum box 10, and therefore the bilge area 32, and as such is not submerged during use. The pump 36 is self-priming.

In use, when the pump 36 is switched on, it draws bilge water from the bilge area 32 through the strum box 10 and pipes 38, 40 and expels it overboard. The straining element 16 removes debris from the bilge water and so helps to prevent the pump 36 from becoming blocked.

The pump 36 preferably includes, or is connected to, a control system (not illustrated) for controlling the operation of the pump 36 in response to receiving one or more control signals. The control system typically comprises electrical and/or electronic circuitry for receiving control signals and operating the pump 36 accordingly. Advantageously, the control system includes a programmable processor.

Referring again to FIGS. 1(*a*) to 1(*c*) and 2(*a*) to 2(*b*), the strum box 10 further includes a liquid level sensor 50 for detecting the level of water around the strum box 10. Depending on the water level detected by the sensor 50, the sensor 50 generates one or more control signals for controlling the operation of the pump 36. The control signals may be communicated to the pump's control system by any suitable means, e.g. by a wired or wireless connection (not illustrated). In the preferred embodiment, the sensor 50 is arranged to detect whether or not the water level meets a threshold level and, if so, to send a control signal to activate the pump 36. If the detected water level is less than the threshold, then the pump 36 is deactivated, or not activated, as applicable. The sensor 50 may send a deactivating signal to the pump 36 when it detects that the water level has dropped below the threshold although, preferably, the pump 36 deactivates itself in the absence of an activating signal from the sensor 50.

Advantageously, the sensor 50 is a non-contact sensor, i.e. it employs means for detecting the level of liquid without having to be in contact with the liquid. In particular non-contact electromagnetic field sensors are preferred, although other non-contact sensors such as RF (radio frequency), capacitative, ultrasonic or magnetic sensors could alternatively be used. In the preferred embodiment, the sensor 50 is an electric field sensor comprising one or more electric field sensing elements.

The sensor 50 does not need to be located on the exterior of the strum box 10 since its sensing element(s) do not need to be in contact with the water. Conveniently, therefore, the sensor 50 is located on an interior surface 52 of the body 12, preferably on the inside of the roof 54 of the body, which in the illustrated embodiment is the roof of the upper body portion 13. In preferred embodiments, the roof 54 of the body 12 corresponds with the roof of the chamber 14, although this need not necessarily be the case. For example, in alternative embodiments, a compartment (not shown) may be provided above the chamber 14 (between the chamber 14 and the roof 54) for housing, for example, electrical components (optionally including the sensor 50). The sensor 50 could be installed at any suitable location in the body 12, for example on or in the wall that divides the chamber 14 from the compartment, or even in a side wall of the body 12. It is preferred however, to provide the sensor 50 substantially at, for example on or in, the in use uppermost surface of the body 12. Alternatively, the sensor 50 may be incorporated into the body 12, preferably in the roof 54, or located inside or outside the body 12, preferably on the roof 54, within a substantially liquid-tight covering (not illustrated).

The sensor 50 generates a sensing field in use that allows the sensor 50 to detect the presence or absence of a liquid, in this case water. The position and orientation of the sensor 50 affects the position and orientation of the sensing field and therefore affects the location of the threshold level for detecting water. When being used to detect a rising water level (and so to cause the pump to be activated), it is preferred that the sensor is arranged such that its sensing field extends, in use, generally upwardly such that there is substantially no sensing field below a horizontal threshold level. Depending on the nature of the sensor 50, the sensing field could for example be substantially hemispherical or beam-like.

In the preferred embodiment where the sensor 15 is located substantially at the top of the body 15, the sensor 50 is positioned, and adapted if necessary, such that the electric field (not illustrated), or other sensing field e.g. electromagnetic or magnetic, that it generates during use extends in a direction substantially away from the strum box 10, i.e. upwards as viewed in FIG. 3. Ideally, any portion of the sensing field that would otherwise extend in the opposite direction, i.e. downwardly, is substantially eliminated or at least suppressed to a level that does not interfere with the operation of the system as herein described. In general, the preferred arrangement is such that the sensing field (or at least the sensing field that is responsible for activating the pump) exists only above said threshold. When the sensor 50 is located at the roof 54, the bilge water impinges on the sensing field only when the roof 54 is covered by the bilge water. When water impinges upon the sensing field, it interacts with the field in a manner that is detectable by the sensor 50. This causes the sensor 50 to send an activation signal to the pump 36, or an output signal that causes an activation signal to be sent. The sensor 50 may send a deactivation signal to the pump 36 when the water level recedes such that the roof 54 is no longer covered, or terminate the activation signal in cases where the absence of the activation signal is used as the deactivating mechanism. It will be seen that the preferred arrangement is such that said threshold level is substantially at the level of the top of the strum box 10. It is advantageous to have the sensor 50 at the top of the strum box 10 since this facilitates interaction between the water and the sensor 50.

In preferred embodiments, the sensor 50 is positioned such that its activation signal is only generated when the strum outlet 20 is covered by liquid. This ensures that the pump 36 does not suck air into the pump system. In the illustrated embodiment, this aim is achieved by locating the sensor 50 at the roof 54 of the body 12 with its sensing field being directed upwardly, since the top of the outlet 20 is located at or below the level of the roof 54. For this reason, it is preferred that the outlet 20 is located in a side wall of the body 54.

In use, the motion of the vessel 34 can cause bilge water to splash over the strum box 10 even when the quiescent water level in the bilge area 32 is not high enough to warrant turning on the pump 36. To avoid false activations of the bilge pump 36, it is preferred that the pump 36 is activated after a delay has elapsed from the time at which the sensor 50 first detects that water level threshold is exceeded when the pump 36 is deactivated. This is conveniently implemented at the pump's control system by, for example, configuring the control system to delay activation of the pump 36 for a period of time after having received an activation signal from the sensor 50 and, at the end of the delay period, to activate the pump 36 only if a deactivation signal has not been received in the meantime, or if the activation signal has not terminated in the meantime (depending on the activation/deactivation protocol). For example a relatively short delay (e.g. 1 second) may be introduced before activating the pump 36 and a longer delay (e.g. 15 seconds) introduced before deactivating the pump 36.

Similarly, to avoid false deactivations of the bilge pump 36, it is preferred that the pump 36 is deactivated after a delay has elapsed from the time at which the sensor 50 first detects that water level has dropped below the threshold when the pump 36 is activated. This is conveniently implemented at the pump's control system by, for example, configuring the control system to delay deactivation of the pump 36 for a period of time after having received a deactivation signal from the sensor 50, or detected a termination of the activation signal, and, at the end of the delay period, to deactivate the pump 36 only if an activation signal has not been received in the meantime.

Alternatively, the delay may be implemented by the sensor 50. For example, the sensor 50 may be arranged to delay sending the activation signal for a period of time until it has verified that the water threshold level has been exceeded, e.g. by establishing that a plurality of successive measurements indicate that the threshold is exceeded. Similarly, the sensor 50 may be arranged to delay sending the deactivation signal, or to delay terminating the activation signal, as appropriate, for a period of time until it has verified that the water threshold level is not exceeded, e.g. by establishing that a plurality of successive measurements indicate that the threshold is not exceeded.

In alternative embodiments (not illustrated) a second sensor, which may substantially the same as the sensor 50, may be provided to deactivate the pump 36 by generating a deactivating signal when the water level is determined to fall below a threshold level. The deactivating threshold level is typically lower, in use, than the threshold level to which the sensor 50 operates. The deactivating sensor is preferably located in the body 12, e.g. mounted on or in a wall of the body. A preferred arrangement is to mount the deactivating sensor directly or indirectly to the ceiling of the body 12 by means of a spacer device such that it is lower, in use, than the sensor 50. The spacer device may for example be connected to the sensor 50. It is preferred that the threshold level of the deactivating sensor is substantially at, or higher than (during use) the top of the outlet 20 to prevent air being sucked into the pump 36. The preferred arrangement is such that the electromagnetic field, or other sensing field, of the deactivating sensor is directed substantially downwardly in use, although other arrangements are possible.

The invention is not limited to the embodiments described herein, which may be modified or varied without departing from the scope of the invention.

The invention claimed is:

1. A straining device for a drainage pump, the straining device comprising a body having a roof and defining an inner chamber; at least one straining element by which liquid may enter the chamber; and at least one outlet by which liquid may leave the chamber, wherein the straining device further includes a liquid level sensor arranged to detect the level of a liquid in which said straining device is located during use and, upon determining that said liquid level exceeds a threshold, to cause an activation signal to be sent to said pump, and wherein said liquid level sensor comprises non-contact sensing means, wherein said liquid level sensor is located substantially at said roof and generates a directed sensing field in use, said liquid level sensor being positioned so that, in use, said directed sensing field extends substantially upwardly from said roof and substantially none of said directed sensing field extends below said threshold.

2. A straining device as claimed in claim 1, wherein said liquid level sensor is located inside said chamber on an inner surface of said roof.

3. A straining device as claimed in claim 1, wherein said liquid level sensor is located on an external surface of said roof, preferably located within a substantially liquid-tight cover.

4. A straining device as claimed in claim 1, wherein said liquid level sensor is incorporated into the body.

5. A straining device as claimed in claim 1, wherein said liquid level sensor includes at least one first liquid level sensing element that generates a sensing field in use, the arrangement being such that the sensing field extends only substantially upwardly in use.

6. A straining device as claimed in claim 1, wherein the liquid level sensor is located at the roof, the arrangement being such that the sensing field extends generally upwardly from the roof in a direction substantially away from the body.

7. A straining device as claimed in claim 1, wherein said liquid level sensor is arranged to cause said activation signal to be generated when the detected liquid level indicates that said at least one outlet is substantially covered by said liquid.

8. A straining device as claimed in claim 7, wherein said at least one outlet is arranged such that its top edge is substantially at or below the level of the roof.

9. A straining device as claimed in claim 8, wherein said at least one outlet is located in a side wall of said body.

10. A straining device as claimed in claim 1, wherein said liquid level sensor is arranged to cause said activation signal to be generated when the detected liquid level indicates that said roof is substantially covered by said liquid.

11. A straining device as claimed in claim 1, wherein said liquid level sensor comprises at least one electric field sensor or at least one other electromagnetic field sensor.

12. A straining device as claimed in claim 1, wherein said liquid level sensor is arranged to cause a deactivation signal to be sent to the pump upon detecting that the liquid level has dropped below the threshold level, or a second threshold level.

13. A straining device as claimed in claim 12, wherein the liquid level sensor is arranged to cause said deactivation signal to be sent only after absence of said liquid has been detected by said sensor at least twice within a threshold period of time.

14. A straining device as claimed in claim 12, including at least one second liquid level sensing element that generates a sensing field in use, the arrangement being such that the sensing field extends substantially downwardly in use, said deactivation signal being dependent on the output of said at least one second liquid level sensing element.

15. A straining device as claimed in claim 14, wherein said at least one second liquid level sensing element is arranged such that said second threshold level is substantially at the top of said outlet, said second threshold level being below, in use, said threshold level.

16. A straining device as claimed in claim 1, wherein the liquid level sensor is arranged to continuously or intermittently cause the activation signal to be sent until it determines that the liquid level has dropped below the threshold level, at which time the activation signal is caused to terminate, termination of the activation signal being an indication that the pump is to be deactivated.

17. A straining device as claimed in claim 1, wherein the liquid level sensor is arranged to cause the activation signal to be sent only after said liquid has been detected by said sensor at least twice within a threshold period of time.

18. A straining device as claimed in claim 1 wherein the liquid level sensor is arranged to cause said activation signal to be terminated only after absence of said liquid has been detected by said sensor at least twice within a threshold period of time.

19. A straining device as claimed in claim 1, wherein said liquid level sensor is arranged such that said threshold level is substantially at the level of a top of said body or substantially at the level of the top of said outlet.

20. A pump system comprising a drainage pump with a pump control system and a straining device, the straining device comprising a body having a roof and defining an inner chamber; at least one straining element by which liquid may enter the chamber; and at least one outlet by which liquid may leave the chamber, wherein the straining device further includes a liquid level sensor arranged to detect the level of a liquid in which said straining device is located during use and, upon determining that said liquid level exceeds a threshold, to cause an activation signal to be sent to said pump control system, and wherein said liquid level sensor comprises non-contact sensing means, wherein said liquid level sensor is located substantially at said roof and generates a directed sensing field in use, said liquid level sensor being positioned so that, in use, said directed sensing field extends substantially upwardly from said roof and substantially none of said directed sensing field extends below said threshold.

21. The pump system of claim 20, wherein said pump control system is configured to deactivate said pump in response to determining from said liquid level sensor that said liquid level does not exceed said threshold.

22. The pump system of claim 21, wherein the control system is arranged to delay deactivation of the pump for a period of time after having received a deactivation signal from the sensor, or detected a termination of the activation signal, and, at the end of the delay period, to deactivate the pump only if an activation signal has not been received in the meantime.

23. The pump system of claim 20, wherein said pump control system is arranged to delay activation of the pump for a period of time after having received an activation signal from the liquid level sensor and, at the end of the delay period, to activate the pump only if a deactivation signal has not been received in the meantime.

24. The pump system of claim 20, wherein said pump control system is arranged to delay activation of the pump for a period of time after having received an activation signal from the liquid level sensor and, at the end of the delay period, to activate the pump only if the activation signal has not terminated in the meantime.

* * * * *